US007615125B2

(12) United States Patent
Bés et al.

(10) Patent No.: US 7,615,125 B2
(45) Date of Patent: Nov. 10, 2009

(54) ALUMINUM ALLOY PRODUCTS WITH HIGH TOUGHNESS AND PRODUCTION PROCESS THEREOF

(75) Inventors: Bernard Bés, Seyssins (FR); Philippe Jarry, Grenoble (FR)

(73) Assignee: Alcan Rhenalu, Paris (FR)

( * ) Notice: Subject to any disclaimer, the term of this patent is extended or adjusted under 35 U.S.C. 154(b) by 487 days.

(21) Appl. No.: 11/232,934

(22) Filed: Sep. 23, 2005

(65) Prior Publication Data

US 2006/0065331 A1 Mar. 30, 2006

(30) Foreign Application Priority Data

Sep. 24, 2004 (FR) ..... 04 10138

(51) Int. Cl.
*C22F 1/05* (2006.01)
*C22F 1/047* (2006.01)

(52) U.S. Cl. ..... 148/552

(58) Field of Classification Search ..... 148/437–440, 148/549–552; 420/528–554
See application file for complete search history.

(56) References Cited

U.S. PATENT DOCUMENTS

| | | | | |
|---|---|---|---|---|
| 4,748,001 | A | 5/1988 | Banerji | |
| 5,104,616 | A | 4/1992 | Baeckerud | |
| 5,186,236 | A | 2/1993 | Gabathuler et al. | |
| 5,480,498 | A | 1/1996 | Beaudoin | |
| 6,077,363 | A * | 6/2000 | Heymes et al. | 148/417 |
| 6,216,521 | B1 * | 4/2001 | Heymes et al. | 72/302 |
| 6,645,321 | B2 | 11/2003 | Sigworth | |
| 2002/0011289 | A1 | 1/2002 | Warner | |
| 2002/0031682 | A1 * | 3/2002 | Dif et al. | 428/654 |

FOREIGN PATENT DOCUMENTS

| | | |
|---|---|---|
| EP | 0493318 | 7/1992 |
| EP | 1158068 | 11/2001 |

(Continued)

OTHER PUBLICATIONS

W.D. Callister, Materials Science and Engineering, 6th ed, copyright 2003, p. 180-184.*

(Continued)

*Primary Examiner*—George Wyszomierski
*Assistant Examiner*—Mark L Shevin
(74) *Attorney, Agent, or Firm*—Baker Donelson Caldwell Bearman & Berkowitz PC

(57) ABSTRACT

Process for manufacturing aluminum alloy products, with high toughness and fatigue resistance comprising: (a) preparing an aluminum alloy bath, (b) adding a refining agent containing particles of AlTiC type phases into the bath, (c) casting an as-cast form such as an extrusion ingot, a forging ingot or a rolling ingot, (d) hot transforming the as-cast form, possibly after scalping, to form a blank or a product with final thickness, (e) optionally cold transforming the blank to a final thickness, (f) applying a solution heat treatment and quenching the product output from (d) or (e), followed by relaxation by controlled stretching with permanent elongation between 0.5 and 5%, and optionally annealing, wherein the quantity of refining agent is chosen such that the average casting grain size of the as-cast form is more than 500 μm. The present invention may be used, for example, to manufacture fuselage sheet or light-gauge plates made with 6056 alloy.

10 Claims, 2 Drawing Sheets

FOREIGN PATENT DOCUMENTS

| | | | | |
|---|---|---|---|---|
| EP | 1158068 | A1 | * | 11/2001 |
| EP | 1205567 | | | 5/2002 |
| GB | 2216542 | | | 10/1989 |
| GB | 2243374 | A | * | 10/1991 |
| JP | 60145365 | | | 12/1985 |
| JP | 04292449 | | | 11/1995 |
| RU | 701000 | | | 3/1996 |

OTHER PUBLICATIONS

R. Dif, et al. Recent developments in AA6056 Aluminum Alloy used for Aerospace, Pechiney Rhenalu, 2001.*

Staley, J.T., Microstructure and Toughness of High-Strength Aluminium Alloys, *Properties Related to Fracture Toughness*, ASTM Special Technical Publication 65, 1976, p. 71-103.

Jarry, et al., Quantification of Spatial Distribution of as-cast Microstructural Features, *Proceedings of the Light Metals 2001 Conference*, Ed. J. L. Anjier, TMS, p. 903-909.

Jarry, et al., Characterisation by the p* method of eutectic aggregates spatial distribution in 5xxx and 3xxx aluminium alloys cast in wedge moulds and comparison with SDAS measurements, *Solidification of Alloys*, ed. M.G. Chu, D.A. Granger and Q. Han, TMS 2004.

* cited by examiner

ALUMINUM ALLOY PRODUCTS WITH HIGH TOUGHNESS AND PRODUCTION PROCESS THEREOF

CROSS REFERENCE TO RELATED APPLICATION

This application claims priority from French application No. 04 10138, filed Sep. 24, 2004, the content of which is incorporated herein by reference in its entirety.

BACKGROUND OF THE INVENTION

1. Field of the Invention

The present invention relates generally to a process for fabrication of rolled aluminium alloy products with high toughness and high fatigue resistance, and products made using such a process. In particular, the instant process comprises refining liquid metal as well as providing sheets or light-gauge plates that may, for example, be used in aircraft fuselage skins and related applications.

2. Description of Related Art

It is generally known that the various properties required during the manufacture of semi-finished products and structural elements for aircraft construction typically cannot all be optimized at the same time independently of each other. When the chemical composition of the alloy or parameters of product production processes are modified, several critical properties may even change in conflicting trends. This is the case particularly for properties included under the term "static mechanical properties" (particularly the ultimate strength $R_m$ and the yield stress $R_{p0.2}$) on the one hand, and properties included under the term "damage tolerance" (particularly toughness and resistance to fatigue crack propagation) on the other hand. Furthermore, some working properties such as fatigue resistance, resistance to corrosion, formability and elongation at failure are linked to the static mechanical properties in a complex and frequently unpredictable manner. Therefore, optimization of all the properties of a material for mechanical construction, for example in the aeronautical sector, frequently depends on a compromise between several key parameters.

For example, Al—Si—Mg—Cu type alloys can be used for structural elements of fuselages for wide body civil aircraft. First, these elements generally should have high mechanical strength, and secondly, possess high toughness and high fatigue resistance. Any new possibility of improving one of these groups of properties without degrading the others would be desirable.

Up to now, efforts made have focused on optimizing the chemical composition of alloys, and optimizing sheets or plate transformation conditions; in other words optimizing rolling and heat treatment sequences.

It was well known that reducing iron and silicon impurities in alloys in the 2xxx and 7xxx series increases the toughness (see J. T. Staley "Microstructure and Toughness of High-Strength Aluminium Alloys" published in the book "Properties Related to Fracture Toughness", ASTM Special Technical Publication 65, 1976, pp 71-103). In some cases, the reduction of Fe and Si also tends to increase fatigue resistance.

There are few studies related to the influence of conditions for refining of liquid metal and casting of as-cast forms (such as billets and ingots) on the toughness of ingots obtained from such as-cast forms.

EP 1 205 567 A (Alcoa Inc.) teaches that the addition of 0.003 to 0.010% of Ti and Boron or Carbon to a wrought alloy will result in cast grain sizes of 200 μm or less.

U.S. 2002/0011289 A1 (Pechiney Rhenalu) teaches that for thick products with only a slightly recrystallized microstructure (in other words in which the fraction of recrystallized grains is less than 35%), a high as-cast grain size could lead to a specific microstructure of the transformed and heat-treated product that has a beneficial effect on toughness. This result is obtained particularly by careful control of the titanium and boron content, these elements being added in the form of $TiB_2$ to refine the metal grain during solidification.

U.S. Pat. No. 5,104,616 (Baeckerud) particularly addresses problems that arise due to hard boride particles in the beverage can and thin aluminium sheet industries and teaches that it may be advantageous to replace a refining agent containing boron with a refining agent containing carbon. However, problems that arise in the aluminium packaging industry such as pin-holes, are incomparable with problems that arise in the aeronautical industry, where product strength and durability are of the utmost importance.

A purpose of the present invention was the provision of a new process for producing highly recrystallized wrought products, preferably rolled products, and particularly sheets or light-gauge plates made of an alloy in the 6xxx series with high mechanical strength that also have excellent toughness and fatigue resistance.

SUMMARY OF THE INVENTION

An object of the instant invention was the provision of a process for manufacturing aluminium alloy products, and particularly highly recrystallized products with high toughness and fatigue resistance comprising:

- preparing an aluminium alloy bath,
- adding a refining agent containing particles of AlTiC type phases into the bath,
- casting an as-cast form such as an extrusion ingot, a forging ingot or a rolling ingot,
- hot transforming the as-cast form, additionally after scalping, to form a blank or a product with a desired final thickness,
- optionally cold transforming the blank to a final thickness to form a product,
- applying a solution heat treatment and quenching to the product, followed by relaxation by controlled stretching with permanent elongation from about 0.5 to about 5%, and optionally annealing,
- wherein the quantity of refining agent is selected such that an average casting grain size of the as-cast form is at least about 500 μm.

Another object of the present invention was providing a rolling ingot that can be obtained by a casting process of the present invention.

Yet another object of the present invention was directed a sheet or light gauge plate that can be obtained using a process and/or using a rolling ingot according to the invention.

Further included as part of the present invention are methods of preparation and usage of systems and treatments according to the present invention.

Additional objects, features and advantages of the invention will be set forth in the description which follows, and in part, will be obvious from the description, or may be learned by practice of the invention. The objects, features and advantages of the invention may be realized and obtained by means of the instrumentalities and combination particularly pointed out in the appended claims.

DETAILED DESCRIPTION OF A PREFERRED EMBODIMENT

Figure 1:
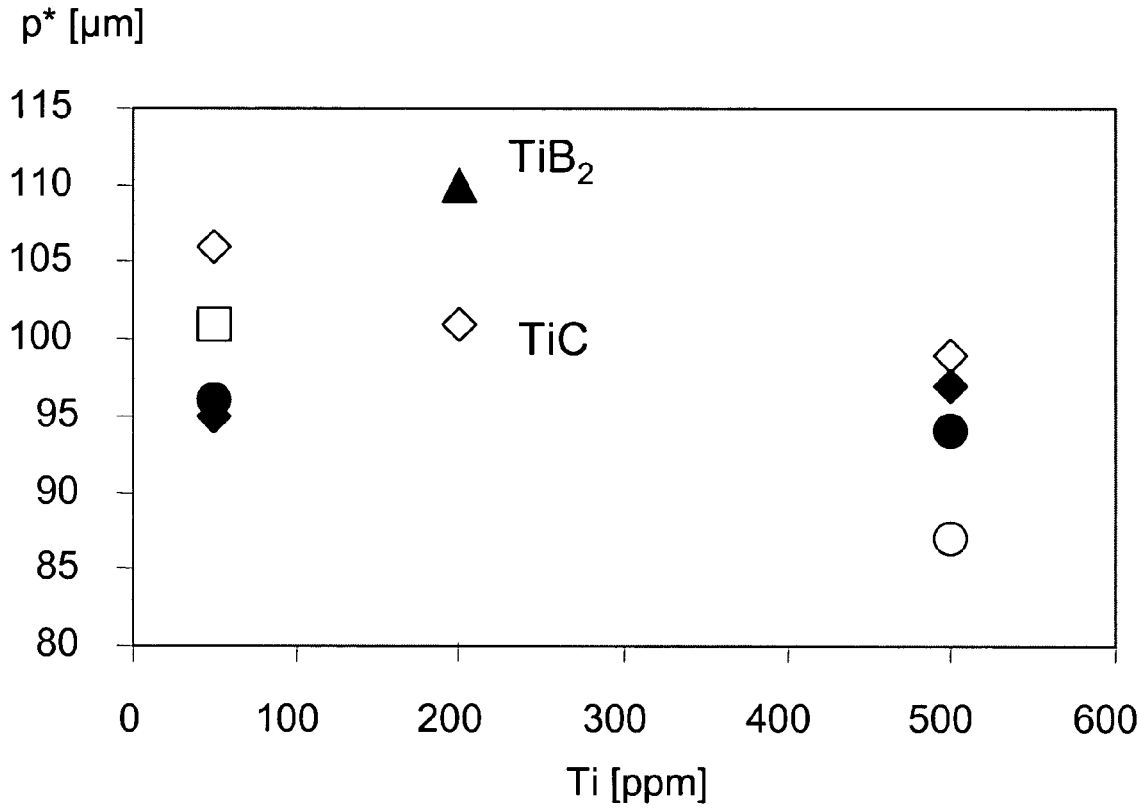
FIG. 1 shows the influence of the refining agent and the titanium content on the parameter p*.

Unless otherwise indicated, all the indications relating to the chemical composition of the alloys are expressed as a mass percentage by weight based on the total weight of the alloy. When the concentration is expressed in ppm (parts per million), this indication also refers to a concentration by mass.

Alloy designations used herein are in accordance with the regulations of The Aluminium Association, known of to those skilled in the art. The tempers are laid down in European standard EN 515. The chemical composition of normalized aluminium alloys is defined, for example, in standard EN 573-3 and in THE ALUMINUM ASSOCIATION publications. These rules, standards and publications are known to those of skill in the art. For the purposes of this description, "alloy in the 6xxx series" or "Al—Mg—Si type alloy" means aluminium alloys (i) for which the chemical composition satisfies one of the standard designations of an alloy in the 6xxx series, or (ii) is derived from an alloy satisfying such a standard designation by adding or removing one or several chemical elements other than silicon or magnesium, and/or by the concentration of one or several chemical elements (including silicon and magnesium) being above or below the standard concentration range for 6xxx, wherein it is understood that in both cases (i) and (ii), application of the standard designation rules would be such that this modified alloy would be classified in the 6xxx series.

Unless otherwise indicated, the static mechanical characteristics, in other words the ultimate tensile strength (UTS, also designated as $R_m$), the tensile yield strength (YS, also designated as TYS or $R_{p0.2}$), the elongation at fracture A and the elongation at necking Ag, of the metal sheets or plates are determined by a tensile test according to standard EN 10002-1, wherein the location and the direction of the test pieces taken are defined in standard EN 485-1. Fatigue resistance is determined by a test defined in standard ASTM E 466, fatigue crack propagation rate (called the da/dn test) by a test according to ASTM R 647, and critical stress intensity factor $K_C$, $K_{CO}$ or $K_{app}$ according to ASTM E 561. The term "extruded product" includes "drawn" products, in other words, products produced by extrusion followed by drawing.

Unless mentioned otherwise, definitions in European standard EN 12258-1 apply.

By "sheet or light-gauge plate" as used herein means a rolled product not exceeding about 12 mm in thickness.

For the purposes of this description, a "structure element" or "structural element" of a mechanical construction means a mechanical part that, if it fails, could endanger the safety of the construction, its users, passengers, and/or others. For an aircraft, these structure elements include particularly, for example, elements making up the fuselage (such as the fuselage skin, stiffeners or stringers, bulkheads, circumferential frames, wings (such as the wing skin), stringers or stiffeners, ribs and spars, and the tail fin composed essentially of the horizontal and vertical stabilizers, and the floor beam, seat tracks and doors.

The present invention may be applicable to any wrought alloys such as those in the 1xxx, 2xxx, 3xxx, 4xxx, 5xxx, 6xxx, 7xxx and 8xxx series, and particularly alloys in the 2xxx, 6xxx and 7xxx series, and more particularly alloys in the 6xxx series. The instant invention is based on one hand, on the discovery that refining of an aluminium alloy using a refining agent containing the right proportion of AlTiC type phases can give a very particular microstructure of the as-cast product, and particularly a grain size larger than about 500 μm and a uniform distribution of intermetallic phases, observed by an optical microscope typically with a magnification of about 50. After hot transformation using known processes, the present invention provides wrought products that surprisingly have a significantly improved toughness and a lower crack propagation rate than is the case for products produced from as-cast forms using known processes, particularly for strongly recrystallized products. A strongly recrystallized product is a product for which the fraction of recrystallized grains measured between one-quarter thickness and mid-thickness of the final wrought product is higher than about 70% by volume. In one advantageous embodiment of the present invention, products output from the solution heat treatment are strongly recrystallized. It is generally known that for slightly recrystallized products, the as-cast microstructure can have an effect on the properties of the transformed product (for example hot rolled, cold rolled and heat treated), but in this case the mechanism of this surprising phenomenon has not yet been elucidated in terms of structural metallurgy. A product produced by a process according to the instant invention is generally different from products according to the state of the art, for example by virtue of the presence of AlTiC type phases. "AlTiC type phases" means any Al—Ti—C ternary phase and any Ti—C binary phase in an aluminium matrix; this term includes the $AlTiC_2$ and TiC phases in particular. These phases are typically added in a refining agent wire. Despite the small quantity of these phases, their effect on the cast microstructure is very clearly defined. Since refining using a wire containing AlTiC type phases can be substituted for refining with wire containing boron (such as AT5B) as is frequently used, an as-cast form produced by the instant process according to the invention can in some cases, and advantageously can contain less than about 0.0001% of boron.

An as-cast microstructure obtained by the process according to the invention is advantageously characterized by two parameters, p* (dimension [μm], and s* (dimension [$\mu m^{-1}$]). In particular, these parameters generally characterize the fineness and uniformity of micro-segregation. The parameter p* characterizes the average distance between precipitates in solidification structures, and therefore the average dimension of zones with no precipitates. The s* parameter characterizes the uniformity of the distribution of these distances. A precise definition of these two parameters and the method of determining them are given in the article entitled "Quantification of Spatial Distribution of as-cast Microstructural Features" by Ph. Jarry, M. Boehm and S. Antoine, published in Proceedings of the Light Metals 2001 Conference, Ed. J. L. Anjier, TMS, pp 903-909, the content of which is incorporated herein by reference in its entirety. The p* parameter is determined by an interlaboratory test performed in the context of the European VIRCAST project, see the article by Ph. Jarry and A. Johansen "Characterisation by the p* method of eutectic aggregates spatial distribution in 5xxx and 3xxx aluminium alloys cast in wedge moulds and comparison with SDAS measurements", published in Solidification of Alloys, ed. M. G. Chu, D. A. Granger and Q. Han, TMS 2004, incorporated herein by reference in its entirety.

The p* and s* parameters are based on an analysis by optical microscopy of polished sections of the as-cast form typically at a magnification of 50, or any other magnification that gives a good compromise between representative sampling of the studied microstructure and the necessary resolution. Images are typically acquired using a CCD (charge-coupled device) type color camera connected to an image analysis computer. The analysis procedure, described in detail in the above-mentioned article by Ph. Jarry, M. Boehm and S. Antoine, incorporated herein by reference in its entirety, comprises the following steps:

a. image acquisition,
b. thresholding of black phases and binary analysis of images with grey levels,
c. deletion of very small phases (for a magnification of 50, a group of less then 5 pixels is considered to be electronic noise),
d. digital analysis of the image using a closing algorithm.

The digital analysis of the image advantageously includes the iterative closing of the image with an increasing pitch. The step i that closes the image $C_i$ is defined by i successive expansions of the image of the same object (one expansion consisting of replacing each pixel in an image by the maximum value of all its neighbours) followed by i successive erosions of the image of the same object (an erosion consisting of replacing each pixel in an image by the minimum value of all its neighbours) in the image d (note that the erosion and expansion operations cannot be inverted). The surface ratio A, that represents the fraction of the surface area of each object, is plotted as a function of the number of closing pitches i. A sigmoid curve is obtained that is then adjusted by a sigmoid function so as to extract the characteristic parameters p* and s*, knowing that p* is the abscissa of the inflection point, expressed in length units, and s* is the slope of the sigmoid curve at the inflection point.

The parameter p* is thus defined by the equation:

$$A = A_{min} + \frac{A_{max} - A_{min}}{(1 + \exp(\alpha(p^* - i)))}$$

in which:

A denotes the surface area fraction of objects after transformation, $A_{min}$ denotes the initial surface area fraction of intermetallic particles after thresholding, $A_{max}$ denotes their surface area fraction corresponding to conventional filling at which the algorithm is normally stopped (in practice 90%) in order to avoid slow convergence problems at the end of filling, i is the number of calculation steps, and $\alpha$ is a sigmoid slope adjustment factor.

The parameter p* represents the average distance between particles present in the matrix.

The other parameter s* is defined by the equation:

$$s^* = \frac{\alpha \times (A_{max} - A_{min})}{4}$$

It has been shown that 1/s* is proportional to the standard deviation of the distribution of distances to the first neighbouring particle. Therefore the s* parameter is a measure of the regularity of the distribution of phases in the matrix.

Therefore the description of the as-cast structure using the s* and p* parameters accounts for the fineness and the uniformity of micro-segregation. The applicant has observed that s* can be more significant in some cases for describing the uniformity of the particle distribution, while p* can be more significant for describing the fineness of their spatial distribution. In one preferred embodiment of the invention, a rolling ingot is prepared using a process according to the invention, so as to obtain a value of s* at least about 0.92 $\mu m^{-1}$, and preferably greater than 0.94 $\mu m^{-1}$. The corresponding value of p* obtained is preferably at most about 107 μm.

According to the present invention, the as-cast form obtained after casting, such as an extrusion ingot, a forging ingot or a rolling ingot, is hot transformed, or optionally cold transformed, to its final thickness. The product at its final thickness can then be subjected to a solution heat treatment and a quenching treatment, followed by relaxation by controlled stretching with a permanent elongation of from about 0.5 to about 5%, optionally followed by annealing. If the permanent elongation obtained during relaxation by controlled stretching is less than about 0.5%, the product may not become sufficiently plane enough in some cases. If the permanent elongation obtained during relaxation by controlled stretching is more than about 5%, the tolerance to damage properties may be affected in some embodiments.

A process according to the instant invention is particularly suitable in some embodiments for producing wrought products made of an alloy in the 6xxx series, and particularly AA6056, AA6156 or similar alloys. It is preferred to limit the iron content to about 0.15% for these two alloys, and even to about 0.13%, to reduce the tendency towards micro-segregation during casting. One advantageous embodiment for heat-treatable alloys includes transformation of the rolling ingot by hot rolling of a sheet or light-gauge plate between 3 and 12 mm, and heat treatment to obtain the T6 temper. If this process is used for the AA6056 or AA6156 alloys, a sheet or light-gauge plate is obtained with damage tolerance $K_R$, determined in the T-L direction for a crack length of $\Delta a_{eff}$, equal to 20 mm using an R curve measured according to ASTM E561 equal to at least 115 MPa$\sqrt{m}$, and preferably at least 116 MPa$\sqrt{m}$.

The said rolling ingot could also be cladded on one or both sides using known operating methods after scalping or possibly after a first hot rolling sequence; for example, this could be advantageous with AA2024, AA6056 and AA6156 alloys.

A sheet or light-gauge plate made from an AA6056 or AA6156 alloy between 3 and 12 mm thick in the T6 temper manufactured by the process according to the invention in one embodiment has a tolerance to damage $K_R$ determined in the T-L direction for a crack extension $\Delta a_{eff}$ equal to 60 mm, obtained from an R curve measured according to ASTM E561, equal to at least 175 MPa$\sqrt{m}$.

Moreover, its crack propagation rate da/dn in the T-L direction, measured according to ASTM E 561 on a panel with width w=400 for $\Delta k$=50 MPa$\sqrt{m}$ and R=0.1, advantageously is less than $2\times10^{-2}$ mm/cycle.

In industrial practice, the improvement of the $K_R$ parameter achieved using the process according to this invention, tends to improve the minimum guaranteed value of this parameter for a given constraint, knowing that like all parameters that characterize a metallurgical product, the $K_R$ parameter can be subject to a certain amount of statistical dispersion.

The following examples contain a description of advantageous embodiments of the invention. These examples are not limitative.

EXAMPLES

Example 1

An AA6056 alloy was cast in two industrial sized rolling ingots with a thickness of 446 mm, at a rate of 55 mm/minute and at a temperature of 680° C. The chemical composition comprised (in % by weight):

| | | | | |
|---|---|---|---|---|
| Si 0.81 | Mg 0.70 | Cu 0.93 | Mn 0.49 | Fe 0.09 |

Table 1 shows the refining method (AlT3C0.15 or AT5B wire). The name AlT3C0.15 denotes a composition Al-3% Ti-0.15% C. The name AT5B denotes a composition Al-5% Ti-1% B; this product is also known under the tradename "AlTiB 5:1"), the Ti content (in ppm by mass), the inoculation ratio and the average values for the s* and p* parameters are as defined above. The s* and p* parameters were determined on sections cut at about 140 mm from the skin and at one third of the width of rolling ingots.

TABLE 1

| Reference | Ti [ppm] | Inoculation ratio [kg/t] | Refining agent | S* | P* |
|---|---|---|---|---|---|
| 4032A | 180 | 0.7 | AT5B | 0.88 | 110 |
| 4032B | 180 | 0.5 | AlT3C0.15 | 0.99 | 101 |

These rolling ingots were used to manufacture clad sheets with a final thickness of 5 mm in the T6 temper using the same transformation procedure comprising homogenisation, hot rolling, solution heat treatment, quenching, relaxation by controlled stretching, and annealing. The permanent elongation obtained during relaxation by controlled stretching was 1.5%. The fraction of recrystallized grains measured between the quarter thickness and the mid-thickness of the finished products was approximately 100%.

The static mechanical characteristics and the damage tolerance properties of these sheets were determined. The results are given in Table 2. The parameter $K_{R(20)}$ relates to a crack extension value $\Delta a_{eff}$ equal to 20 mm.

The crack propagation rate da/dn was also determined according to ASTM E 647 for a sheet with a width w=400 mm in the T-L direction, and a ratio R=0.1.

TABLE 2

| Parameter | Reference 4032A | Reference 4032B |
|---|---|---|
| $R_{m(L)}$ [MPa] | 369 | 373 |
| $R_{p0.2(L)}$ [MPa] | 353 | 355 |
| $A_{(L)}$ [%] | 15.0 | 14.2 |
| $R_{m(TL)}$ [MPa] | 372 | 375 |
| $R_{p0.2(TL)}$ [MPa] | 340 | 342 |
| $A_{(TL)}$ [%] | 13.0 | 12.5 |
| $K_{R(20)(T-L)}$ [MPa√m] | 113 | 119 |
| $K_{R(40)(T-L)}$ [MPa√m] | 148 | 153 |
| $K_{R(60)(T-L)}$ [MPa√m] | 172 | 178 |
| da/dn for Δk = 10 MPa√m [mm/cycle] | $1.10 \times 10^{-4}$ | $1.50 \times 10^{-4}$ |
| da/dn for Δk = 30 MPa√m [mm/cycle] | $3.62 \times 10^{-3}$ | $2.90 \times 10^{-3}$ |
| da/dn for Δk = 50 MPa√m [mm/cycle] | $2.62 \times 10^{-2}$ | $1.85 \times 10^{-2}$ |

It can be seen that the static mechanical characteristics of the two sheets are not significantly different. On the other hand, the resistance to damage, represented by the $K_R$ parameter, increases significantly when the liquid metal is refined with a wire containing AlTiC type phases. The crack propagation rate for the latter product is lower when the stress intensity factor is about 30 MPa√m.

Example 2

Other rolling ingots made of the AA6056 alloy were cast using the process according to the invention. The refining parameters and the casting microstructure are summarised in table 3.

TABLE 3

| Reference | Ti [ppm] | Inoculation ratio [kg/t] | Refining agent | S* | P* |
|---|---|---|---|---|---|
| 4031A | 50 | 0.5 | AlT3C0.15 | 0.95 | 106 |
| 4031B | 50 | 1 | AlT3C0.15 | 0.98 | 101 |
| 4033A | 430 | 0.5 | AlT3C0.15 | 1.00 | 99 |
| 4033B | 430 | 2 | AlT3C0.15 | 1.04 | 87 |
| 4034A | 630 | 0.5 | AlT3C0.15 | 0.98 | 97 |
| 4034B | 630 | 2 | AlT3C0.15 | 1.01 | 94 |
| 4035A | 80 | 0.5 | AlT3C0.15 | 0.99 | 95 |
| 4035B | 80 | 0.5 | AlT3C0.15 | 0.98 | 96 |

Figure 2:
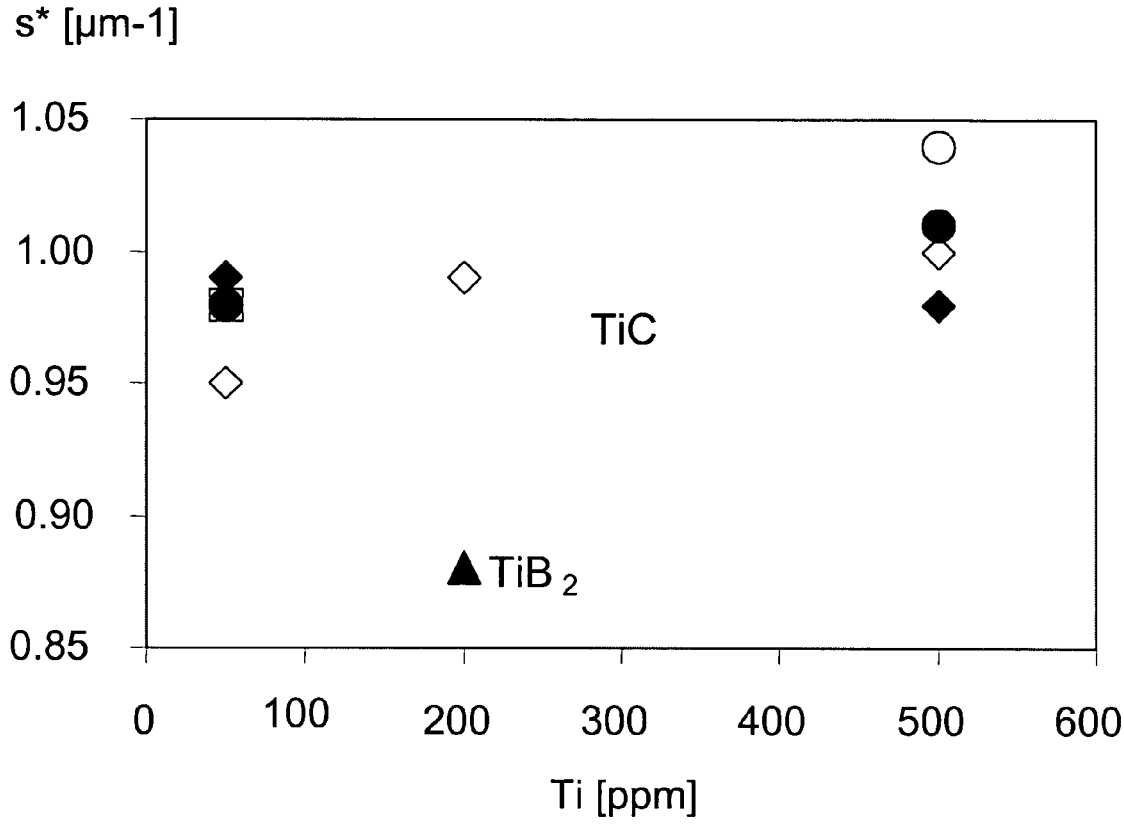
FIG. 2 shows the influence of the refining agent and the titanium content on the parameter s*. The black triangle in both figures represents an alloy using a $TiB_2$ refining agent, while the other two alloys are refined with AlTiC.

FIG. 1 is based on the data and results in tables 1 and 3, and shows a comparison of the finenesses of as-cast microstructures (parameter p*) as a function of the content of Ti and the type of refining agent. Similarly, FIG. 2 contains a comparison of the regularity of as-cast microstructures (parameter s*).

Comment on Examples 1 and 2

Table 4 summarizes the total Ti content in the alloys in examples 1 and 2, and the size of as-cast grains.

TABLE 4

| | Refining agent | | Ti | Fe | As-cast Grain size | | |
|---|---|---|---|---|---|---|---|
| Reference | Type | kg/t | [ppm] | (%) | Average [μm] | Standard deviation | IC |
| 4031A | AlTiC | 0.5 | 50 | 0.09 | 902 | 214 | 153 |
| 4031B | AlTiC | 1 | 50 | 0.09 | 655 | 101 | 72 |
| 4032A | AT5B | 0.7 | 180 | 0.08 | 388 | 38 | 27 |
| 4032B | AlTiC | 0.5 | 180 | 0.08 | 713 | 112 | 80 |
| 4033A | AlTiC | 0.5 | 430 | 0.07 | 757 | 143 | 102 |
| 4033B | AlTiC | 2 | 430 | 0.07 | 664 | 200 | 143 |
| 4034A | AlTiC | 0.5 | 630 | 0.2 | 833 | 201 | 144 |
| 4034B | AlTiC | 2 | 630 | 0.2 | 644 | 113 | 81 |
| 4035A | AlTiC | 0.5 | 80 | 0.2 | 771 | 171 | 122 |
| 4035B | AlTiC | 0.5 | 80 | 0.2 | 822 | 118 | 84 |

The Ti and C content added by the refining wire may be calculated from the inoculation ratios and the wire composition.

Classical refining at 0.7 kg/t of ATB5 introduces about 7 ppm of B. Refining with 1 kg/t of wire type AT3C0.15 as used for these tests introduces about 1.5 ppm of C. Refining of 0.5 kg/t of the same wire introduces about half this amount of C, namely about 0.75 ppm, while refining of 2 kg/t introduces about twice as much, namely about 3 ppm. For titanium, refining of 1 kg/t of AT3C0.15 introduces about 30 ppm, refining of 0.5 kg/t adds half this amount (about 15 ppm) and refining of 2 kg/t adds twice this amount (about 60 ppm).

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

All documents referred to herein are specifically incorporated herein by reference in their entireties.

As used herein and in the following claims, articles such as "the", "a" and "an" can connote the singular or plural.

The invention claimed is:

1. A process for manufacturing aluminum alloy products of an AA6056 alloy or AA6156 alloy with high toughness and fatigue resistance, said process comprising:

preparing an alloy bath, adding a refining agent containing particles of AlTiC type phases into the bath, casting an as-cast form, hot transforming the as-cast form, optionally after scalping, to form (i) a blank or (ii) a product having a desired final thickness between 3 and 12 mm, optionally cold transforming the blank to a desired final thickness between 3 and 12 mm if a blank is formed during said hot transformation, applying solution heat treatment and quenching to the product, followed by relaxation by controlled stretching with permanent elongation between 0.5 and 5%, and optionally annealing, wherein the quantity of refining agent is selected such that the average casting grain size of the as-cast form is at least about 500 μm, and wherein a recrystallized fraction measured between a quarter thickness and a mid-thickness of said product is at least about 70%.

2. A process according to claim 1, wherein the quantity of refining agent is selected such that there is a substantially uniform distribution of intermetallic phases of the as-cast form, where observed by an optical microscope with a magnification of about 50.

3. A process according to claim 1, wherein said as-cast form contains at most about 0.0001% of boron.

4. A process according to claim 1 wherein the iron content is at most about 0.15%.

5. A process according to claim 1, wherein the as-cast form comprises a rolling ingot.

6. A process according to claim 5, wherein said rolling ingot is cladded on one or two sides thereof; after scalping or optionally after a first hot rolling sequence.

7. A process according to claim 1, wherein the iron content is at most about 0.13%.

8. A process according to claim 1, wherein said as-cast form comprises an extrusion ingot, a forging ingot or a rolling ingot.

9. A process according to claim 1, where the as-cast form comprises a rolling ingot.

10. A process according to claim 9, wherein said rolling ingot is cladded on one or two sides thereof, after scalping or optionally after a first hot rolling sequence.

* * * * *

UNITED STATES PATENT AND TRADEMARK OFFICE

CERTIFICATE OF CORRECTION

PATENT NO. : 7,615,125 B2
APPLICATION NO. : 11/232934
DATED : November 10, 2009
INVENTOR(S) : Bés et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 737 days.

Signed and Sealed this

Nineteenth Day of October, 2010

David J. Kappos

David J. Kappos
*Director of the United States Patent and Trademark Office*